US007252552B2

(12) United States Patent
Takimura et al.

(10) Patent No.: US 7,252,552 B2
(45) Date of Patent: Aug. 7, 2007

(54) CONNECTOR HAVING AN ELECTRONIC ELEMENT BUILT THEREIN WITHOUT DISTURBING A CHARACTERISTIC IMPEDANCE

(75) Inventors: Yuta Takimura, Tokyo (JP); Kouichi Ishii, Akita (JP)

(73) Assignees: Japan Aviation Electronics Industry, Limited, Tokyo (JP); TDK Corporation, Tokyo (JP)

( * ) Notice: Subject to any disclaimer, the term of this patent is extended or adjusted under 35 U.S.C. 154(b) by 0 days.

(21) Appl. No.: 11/444,097

(22) Filed: May 31, 2006

(65) Prior Publication Data

US 2006/0276064 A1 Dec. 7, 2006

(30) Foreign Application Priority Data

Jun. 1, 2005 (JP) ..... 2005-161090

(51) Int. Cl.
*H01R 13/66* (2006.01)

(52) U.S. Cl. ..... 439/620.22

(58) Field of Classification Search ..... 439/620.06, 439/620.07, 620.12, 620.13, 620.15, 620.16, 439/620.22, 620.24
See application file for complete search history.

(56) References Cited

U.S. PATENT DOCUMENTS 3,651,432 A * 3/1972 Henschen et al. ..... 333/33
4,913,664 A * 4/1990 Dixon et al. ..... 439/607
4,993,956 A * 2/1991 Pickles et al. ..... 439/76.1
6,290,538 B1 * 9/2001 Pocrass ..... 439/578
6,361,358 B1 * 3/2002 Kajinuma ..... 439/497

FOREIGN PATENT DOCUMENTS

JP 6-151011 5/1994
JP 2000 252020 9/2000

* cited by examiner

*Primary Examiner*—James R. Harvey
*Assistant Examiner*—Travis Chambers
(74) *Attorney, Agent, or Firm*—Collard & Roe, P.C.

(57) ABSTRACT

In a connector to be mounted to a connection object, an insulating housing holds a first and a second contact and has a receiving portion for receiving and holding a circuit board with an electronic element mounted thereon. The first contact has a first contacting portion to be contacted with a mating connector and a first elastic contacting portion brought into elastic contact with the circuit board. The second contact has a second contacting portion to be connected to the connection object and a second elastic contacting portion brought into elastic contact with the circuit board. Conductive first and conductive second connecting portions are disposed on the circuit board to be connected to the first and the second elastic contacting portions, respectively. In addition, a pair of ground patterns is disposed on the circuit board with the first and the second connecting portions interposed therebetween.

7 Claims, 8 Drawing Sheets

CONNECTOR HAVING AN ELECTRONIC ELEMENT BUILT THEREIN WITHOUT DISTURBING A CHARACTERISTIC IMPEDANCE

This application claims priority to prior Japanese patent application JP 2005-161090, the disclosure of which is incorporated herein by reference.

BACKGROUND OF THE INVENTION

This invention relates to a connector having an electronic element built therein.

For example, a connector of the type is disclosed in Japanese Unexamined Patent Application Publication (JP-A) No. 2000-252020. In the connector, a contact to be fitted to a mating connector is electrically connected to a cable through a substrate. The contact is inserted into a through hole of the substrate and connected to the through hole by soldering. By mounting electronic elements to the substrate, various functions are added to the connector.

Another connector of the type is disclosed in Japanese Unexamined Patent Application Publication (JP-A) No. H6-151011. In the connector, a hybrid board with semiconductor components mounted thereto is built in a casing. A contact to be fitted to a mating connector is fixed to the hybrid board by soldering. In this connector also, various functions are added to the connector by the semiconductor components.

In either case, however, the substrate or the hybrid board built in the connector is connected to the contact by soldering. It is therefore difficult to control impedance characteristics and signal degradation may occur due to impedance mismatching. In particular, in case where the contact is connected to the through hole of the substrate by soldering, impedance degradation is remarkable.

The impedance characteristics depend upon the shape of a soldering portion and the amount of a solder and are unstable. Further, a soldering step is required in a production process so that the connector is increased in cost.

SUMMARY OF THE INVENTION

It is therefore an object of this invention to provide a connector capable of connecting an electronic element without disturbing a characteristic impedance.

It is another object of this invention to provide a connector capable of adding various functions such as amplification, attenuation, filtering, waveform shaping, and so on to the connector.

It is still another object of this invention to provide a connector which is capable of saving a space and which is improved in electric characteristics.

It is yet another object of this invention to provide a connector capable of suppressing occurrence of variation in characteristics and reducing a production cost.

It is a further object of this invention to provide a connector capable of saving a mounting space without requiring a circuit to be formed on a connection object.

It is a still further object of this invention to provide a connector having an effect of suppressing electromagnetic radiation generated by or received by a circuit board built in the connector.

It is a yet further object of this invention to provide a connector capable of reducing an influence of temperature variation upon a circuit board during a soldering step when the connector is mounted to the connection object.

It is an additional object of this invention to provide a connector capable of increasing a resonance frequency of a circuit board.

According to an aspect of the present invention, there is provided a connector to be mounted to a connection object, the connector comprising a conductive first contact, a conductive second contact, an insulating housing holding the first and the second contacts, and a circuit board with an electronic element mounted thereon, the housing having a receiving portion for receiving and holding the circuit board, the first contact comprising a first contacting portion to be contacted with a mating connector and a first elastic contacting portion brought into elastic contact with the circuit board, the second contact comprising a second contacting portion to be connected to the connection object and a second elastic contacting portion brought into elastic contact with the circuit board, the circuit board comprising a conductive first connecting portion disposed on the circuit board to be connected to the first elastic contacting portion, a conductive second connecting portion disposed on the circuit board to be connected to the second elastic contacting portion, and a pair of ground patterns disposed on the circuit board with the first and the second connecting portions interposed therebetween.

DESCRIPTION OF THE PREFERRED EMBODIMENT

Figure 1:
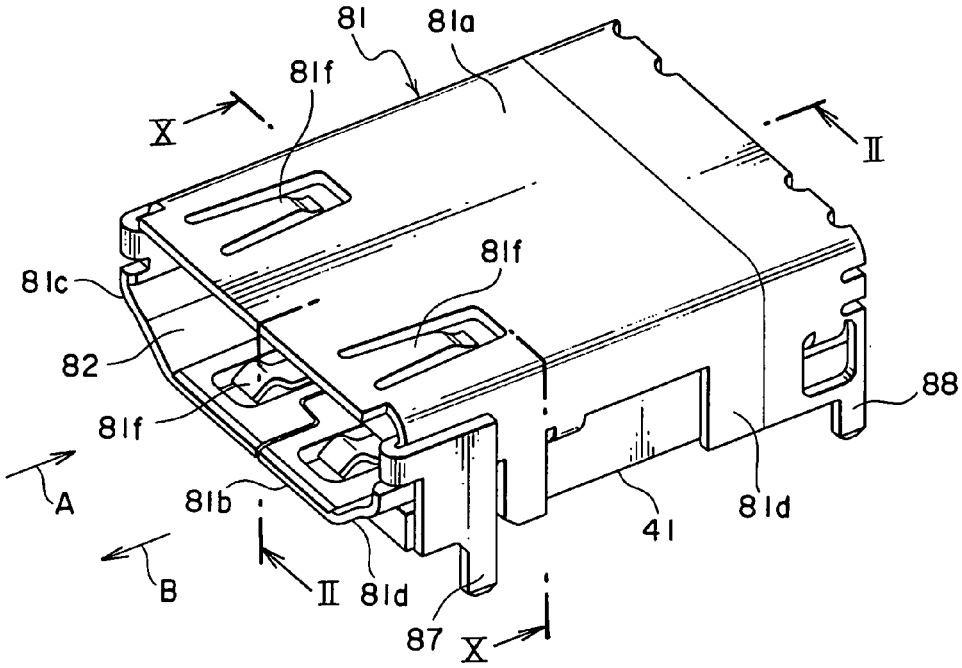
FIG. 1 is a perspective view of an external appearance of a connector according to an embodiment of this invention.
Figure 2:
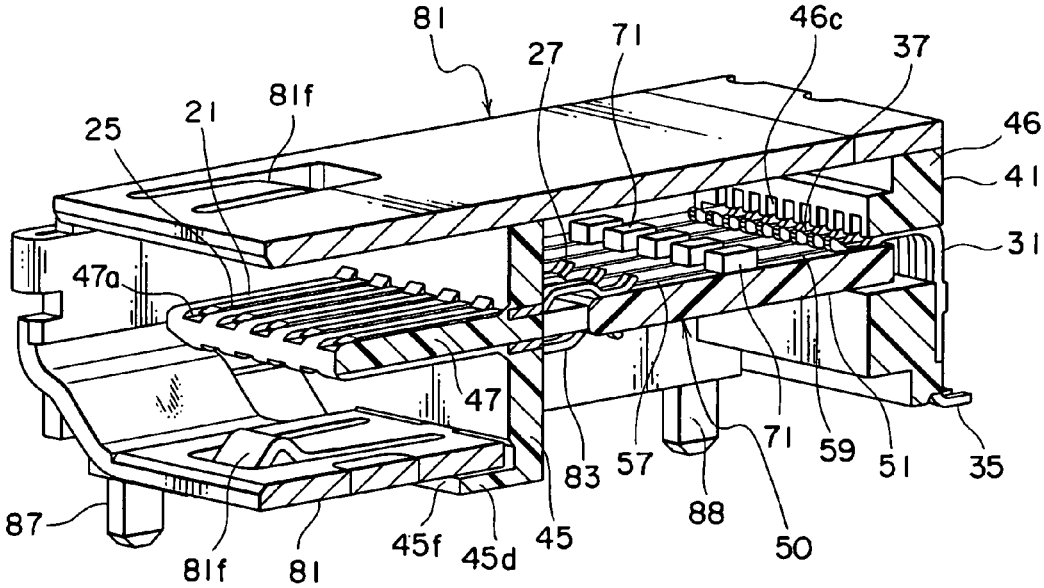
FIG. 2 is a sectional perspective view of the connector, taken along a line II-II in FIG. 1.
Figure 3:
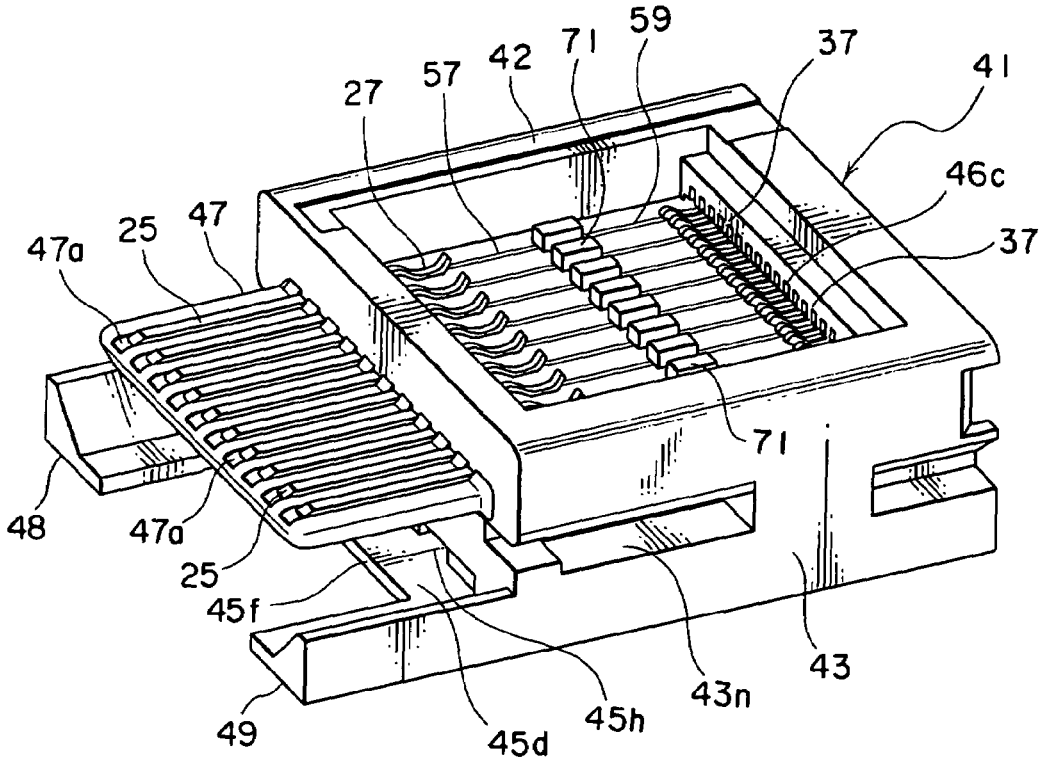
FIG. 3 is a perspective view of the connector in FIG. 1 in a state where a shell is removed therefrom.
Figure 4:
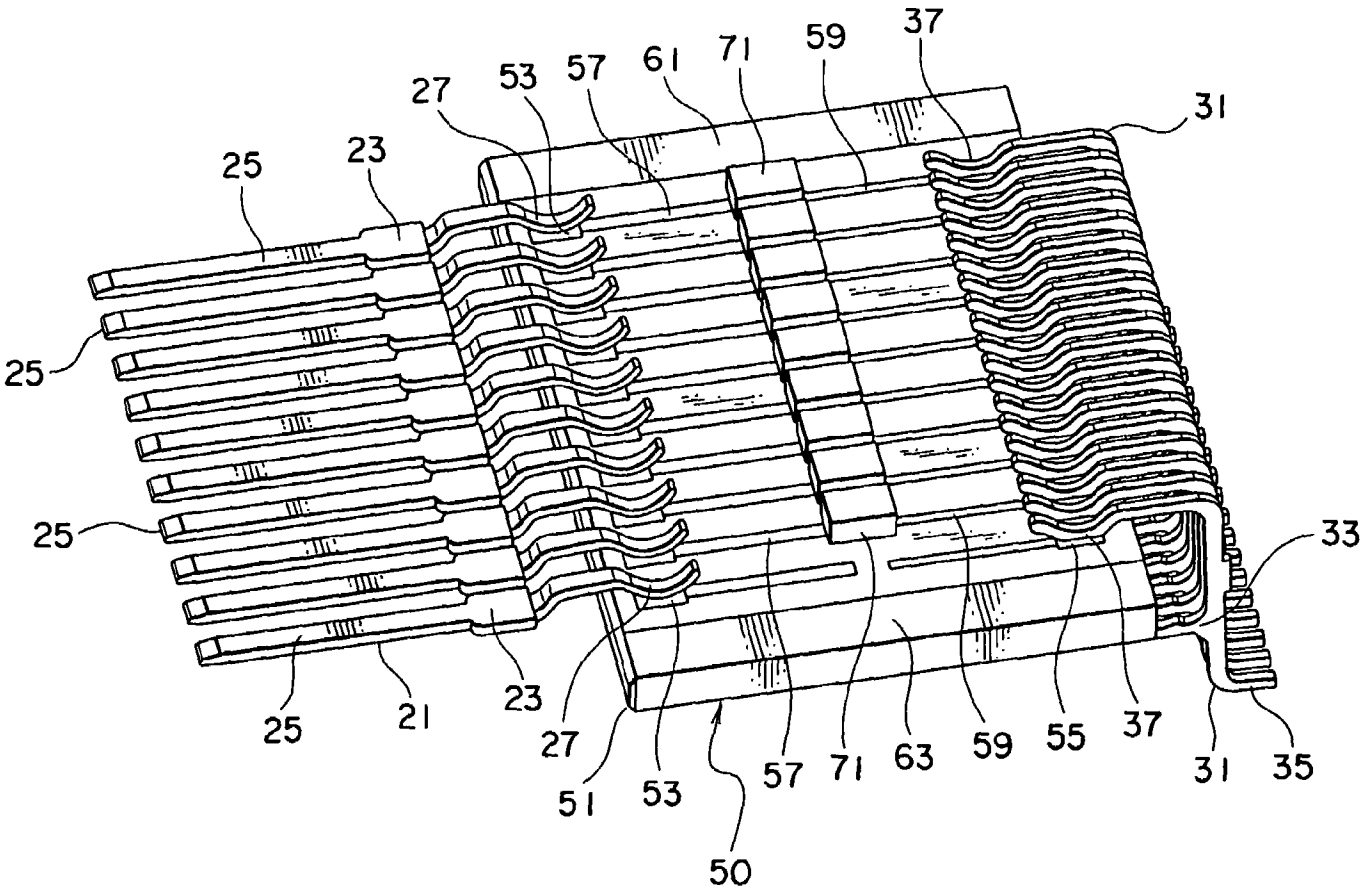
FIG. 4 is a perspective view showing the relationship between contacts and a circuit board module in the connector in FIG. 1.
Figure 5:
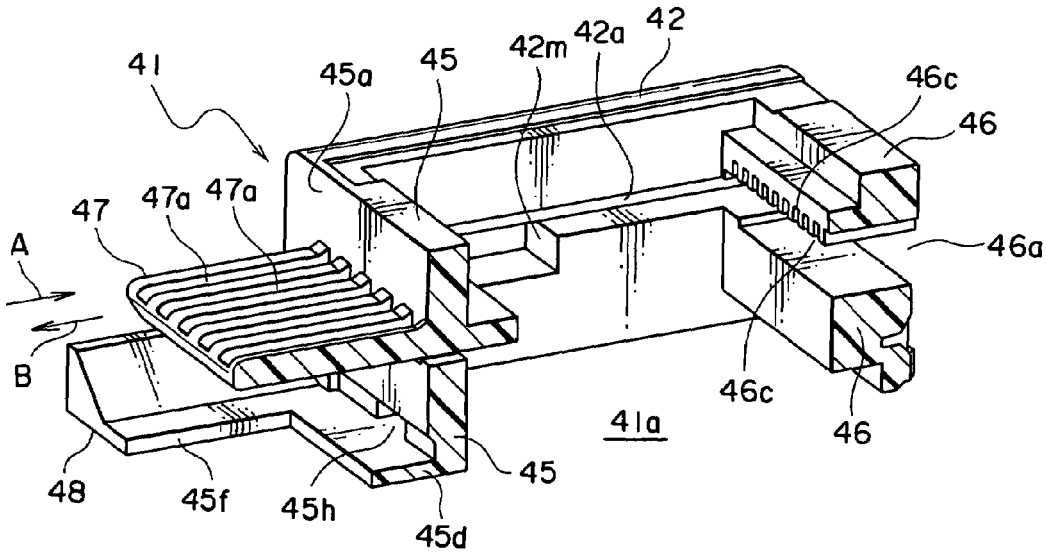
FIG. 5 is a sectional perspective view of a housing in the connector in FIG. 1.

Referring to FIGS. 1 through 5, a whole of a connector according to an embodiment of this invention will be described.

The connector illustrated in the figures comprises a plurality of conductive first contacts 21, a plurality of conductive second contacts 31, an insulating housing 41 holding the first and the second contacts 21 and 31, a circuit board 51 disposed in the housing 41, and a metal shell 81 covering the housing 41 on its outside.

The first and the second contacts 21 and 31 are connected to the circuit board 51. Each of the first contacts 21 has a first holding portion 23 held by the housing 41, a first contacting portion 25 to be contacted with a mating connector (not shown), and a first elastic contacting portion 27 elastically contacted with the circuit board 51. Each of the second contacts 31 has a second holding portion 33 press-fitted into and held by a rear wall portion 46 of the housing 41, a second contacting portion 35 to be connected to a connection object (not shown) to which the connector is mounted, and a second elastic contacting portion 37 elastically contacted with the circuit board 51.

The housing 41 has a pair of side wall portions 42 and 43 parallel to each other, a front wall portion 45 connecting one ends of the side wall portions 42 and 43, the rear wall portion 46 connecting the other ends of the side wall portions 42 and 43, a fitting portion 47 of a flat shape extending from a front surface 45*a* of the front wall portion 45 in a separating direction B opposite to a fitting direction A in which the mating connector is fitted, and a pair of frame portions 48 and 49 extending from the front surface 45*a* of the front wall portion 45 in the separating direction B. Therefore, the housing 41 has a hollow receiving portion 41*a* defined by the side wall portions 42 and 43, the front wall portion 45, and the rear wall portion 46 to receive the circuit board 51.

Further, the side wall portion 42 has a guide groove 42*a* formed on an inner surface thereof and extending long in the fitting direction A and the separating direction B to guide the circuit board 51 towards the receiving portion 41*a*. Similarly, the other side wall portion 43 also has a guide groove (not shown) formed on its inner surface and extending long in the fitting direction A and the separating direction B.

The fitting portion 47 is provided with a plurality of first groove portions 47*a* penetrating the front wall portion 45. In the first groove portions 47*a*, the first contacting portions 25 of the first contacts 21 are disposed in one-to-one correspondence. The holding portions 23 of the first contacts 21 are held by the front wall portion 45.

The frame portions 48 and 49 are connected to a plate-like substrate portion 45*d* extending from the front surface 45*a* of the front wall portion 45 in the fitting direction A. The substrate portion 45*d* is provided with a cut portion 45*f* extending in the fitting direction A from an end edge in the separating direction B. The front wall portion 45 is provided with press-fit holes 45*h* penetrating the front wall portion 45 from the front surface 45*a* to the receiving portion 41*a*.

The rear wall portion 46 is provided with an opening portion 46*a* for allowing the circuit board 51 to be inserted and received in the receiving portion 41*a*. The opening portion 46*a* has a plurality of second groove portions 46*c* formed on its top surface. In the second groove portions 46*c*, the second elastic contacting portions 37 of the second contacts 31 are disposed in one-to-one correspondence.

Figure 6:
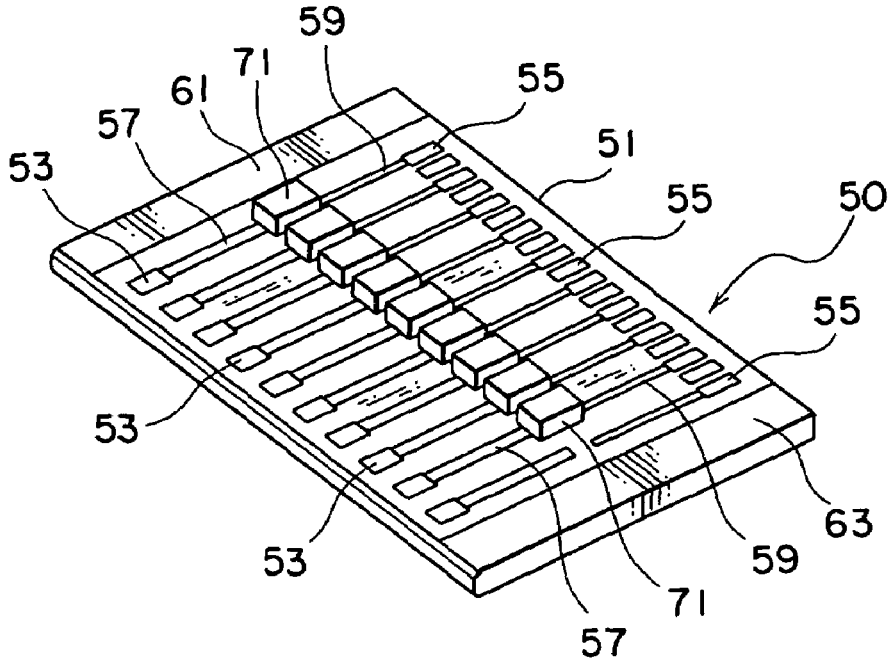
FIG. 6 is a perspective view of the circuit board module in the connector in FIG. 1 as seen from a top side.
Figure 7:
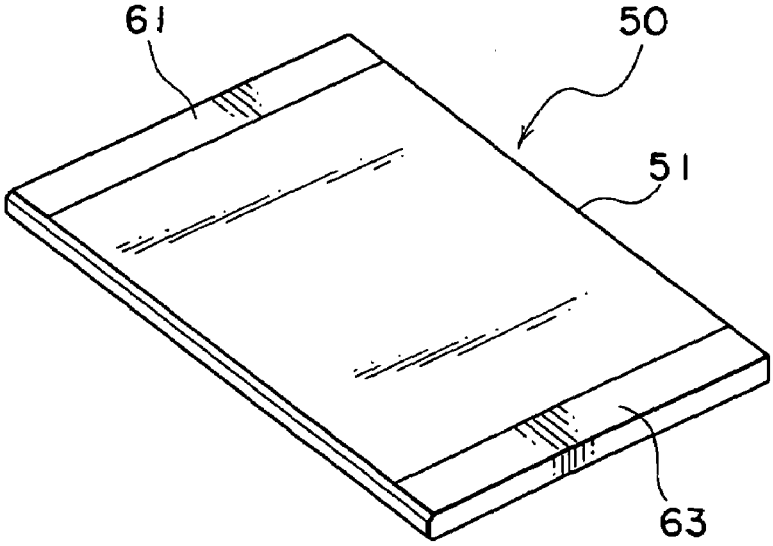
FIG. 7 is a perspective view of the circuit board module in FIG. 6 as seen from a bottom side.

Referring to FIGS. 6 and 7 in addition, the circuit board 51 will be described.

The circuit board 51 has a generally rectangular shape. The circuit board 51 has one surface, i.e., a top surface provided with a plurality of first connecting portions (conductive pads) 53 disposed at its one end portion, a plurality of second connecting portions (conductive pads) 55 disposed at its opposite end portion, a plurality of first circuit patterns 57 connected to the first connecting portions 53, respectively, and a plurality of second circuit patterns 59 connected to the second connecting portions 55, respectively. The circuit board 51 has a pair of ground patterns 61 and 63 each of which extends across the top surface and a bottom surface thereof. On the top surface of the circuit board 51, the ground patterns 61 and 63 are spaced from the first and the second connecting portions 53 and 55.

The first connecting portions 53 are arranged in one-to-one correspondence to the first elastic contacting portions 27 of the first contacts 21. The second connecting portions 55 are arranged in one-to-one correspondence to the second elastic contacting portions 37 of the second contacts 31.

On the circuit board 51, a plurality of electronic elements 71 are mounted. The electronic elements 71 are connected between the first and the second circuit patterns 57 and 59. As will later be described, the type of the electronic elements 71 is appropriately selected depending upon a desired circuit function to be formed between the first and the second contacts 21 and 31.

A combination of the circuit board 51 and the electronic elements 71 mounted thereon will be called a circuit board module 50 in the present specification.

Figure 8:
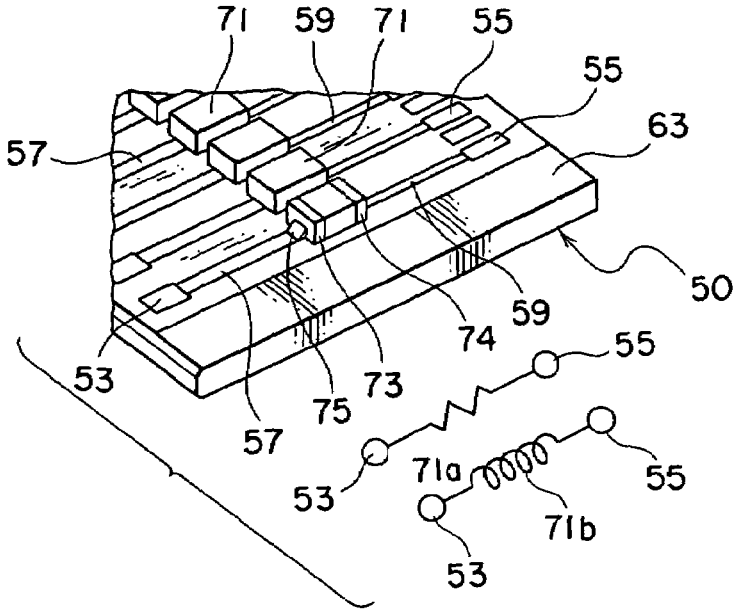
FIG. 8 is a view for describing a modification of the circuit board module in FIG. 6.
Figure 9:
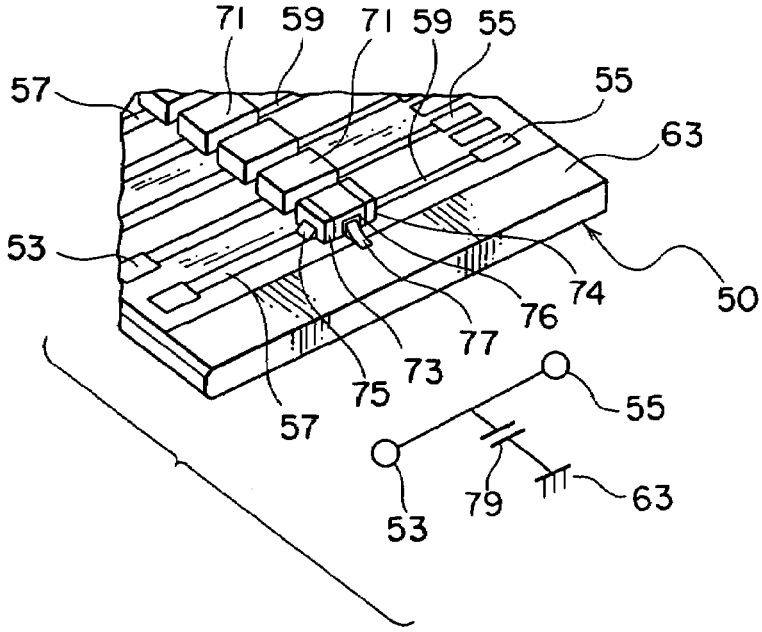
FIG. 9 is a view for describing another modification of the circuit board module in FIG. 6.
Figure 10:
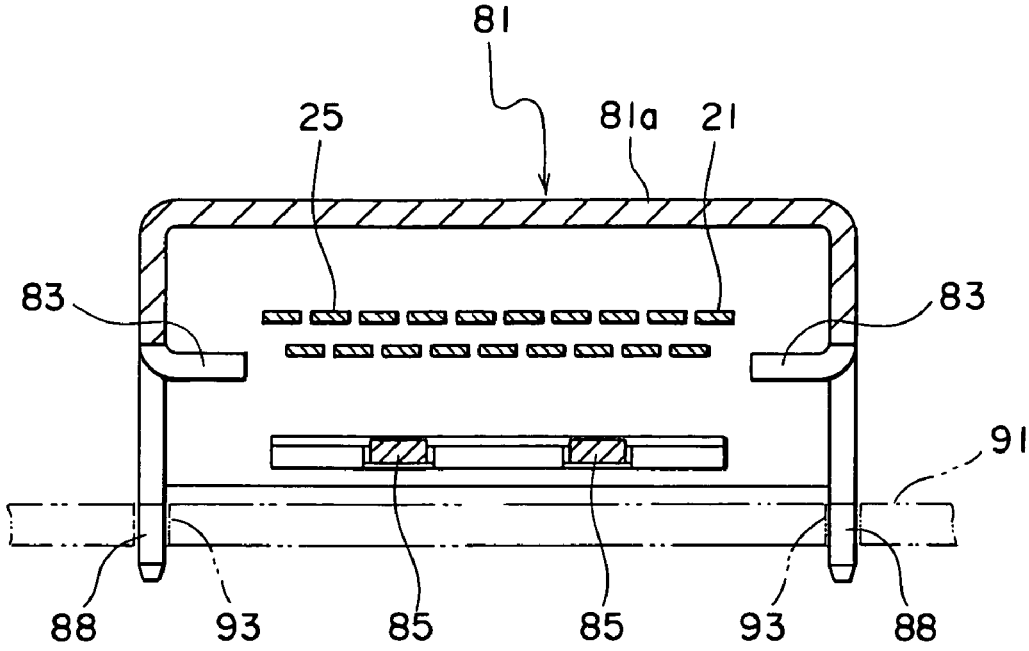
FIG. 10 is a sectional view taken along a line X-X in FIG. 1 in a state where the circuit board module is removed therefrom.
Figure 11:
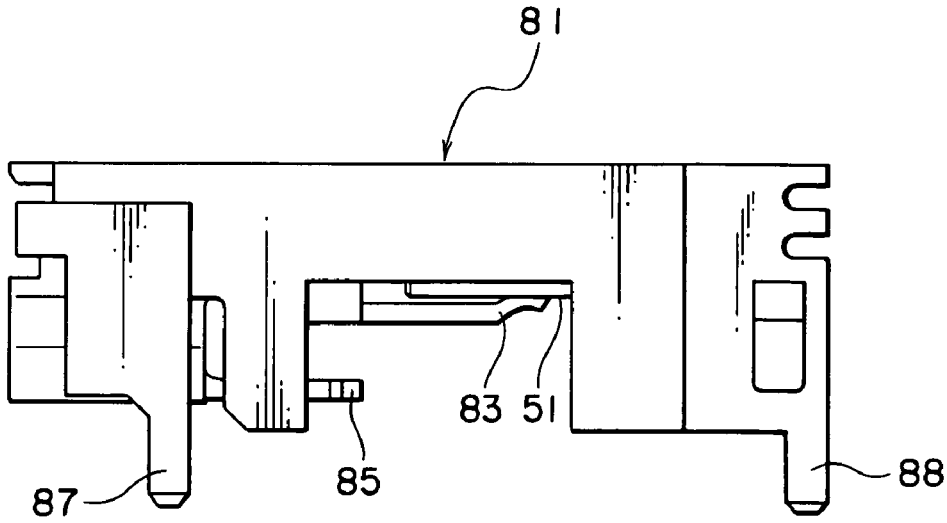
FIG. 11 is a side view of the connector illustrated in FIG. 1.
Figure 12:
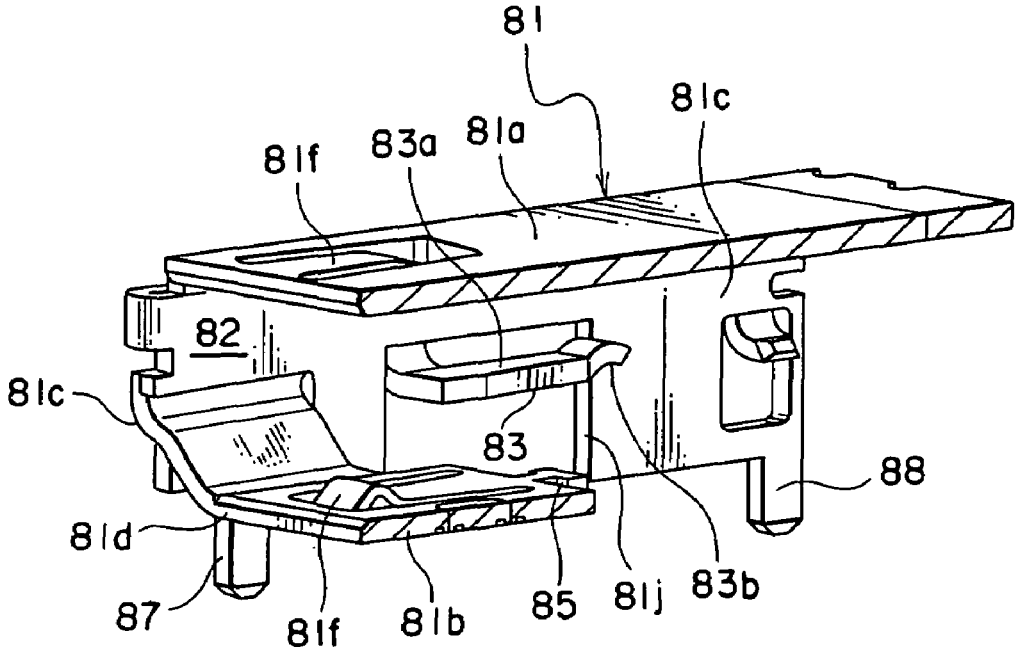
FIG. 12 is a vertical sectional perspective view of a shell in the connector in FIG. 1.
Figure 13:
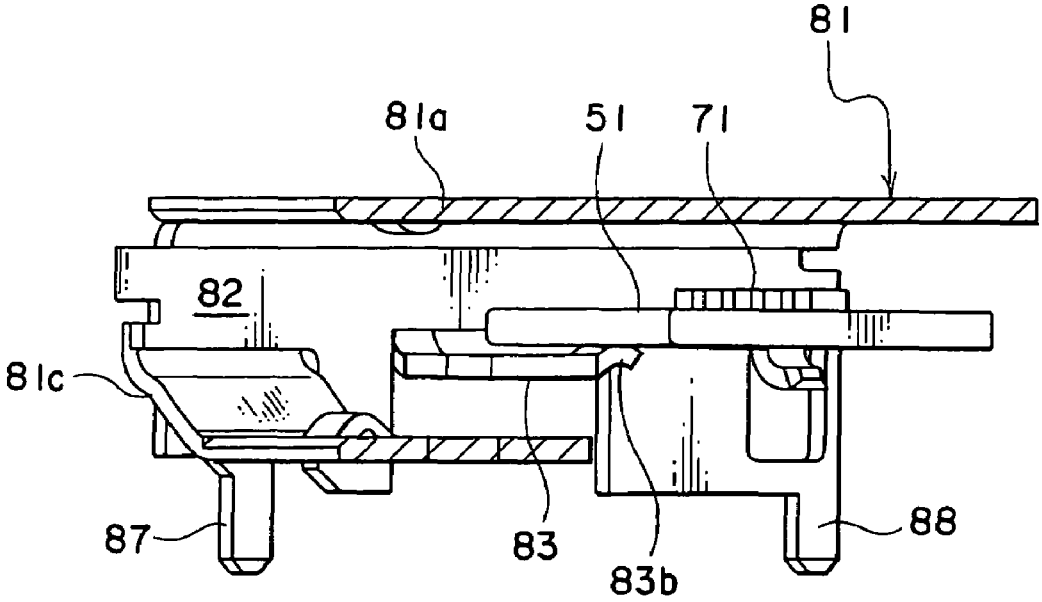
FIG. 13 is a sectional perspective view showing a relationship of connection between the shell in FIG. 12 and the circuit board module.

Referring to FIGS. 8 and 9, a modification of the circuit board module 50 will be described.

The circuit board module 50 in FIG. 8 uses resistor elements or inductance elements as the electronic elements 71. Each of the electronic elements 71 is provided with electrodes 73 and 74 formed on its surface on front and rear sides. The electrodes 73 and 74 are connected by a solder 75 to the first and the second circuit patterns 57 and 59. In this case, a resistor 71*a* or an inductor 71*b* is inserted in series between the first and the second connecting portions 53 and 55. In case of the resistor 71*a*, the electronic element 71 has an attenuation function. On the other hand, in case of the inductor 71*b*, the electronic element 71 has a low-pass filter function.

The circuit board module 50 in FIG. 9 uses three-terminal capacitors as the electronic elements 71. Each of the electronic elements 71 is provided with the electrodes 73 and 74 formed on its surface on front and rear sides. Further, the electronic element 71 is provided with an electrode 76 formed on its one side surface. The electrodes 73, 74, and 76 are connected by solders 75 and 77 to the first circuit pattern 57, the second circuit pattern 59, and the ground pattern 63, respectively. With this structure, a capacitor 79 is inserted in parallel between the first and the second connecting portions 53 and 55. In this case, the electronic element 71 has a low-pass filter function.

Referring to FIGS. 10 to 13 in addition, the shell 81 will be described. The shell 81 has a top plate portion 81*a*, a bottom plate portion 81*b* faced to the top plate portion 81*a*, and a pair of side plate portions 81*c* and 81*d* connecting the top and the bottom plate portions 81*a* and 81*b*. The shell 81 is provided with a pair of ground connecting portions 83, a pair of press-fit terminal portions 85, and a plurality of ground connection terminal portions 87 and 88. The ground connecting portions 83 are inserted into housing hole portions 42*n* and 43*n* formed on the side wall portions 42 and 43 of the housing 41, respectively. The ground connecting portions 83 are connected to the ground patterns 61 and 63 of the circuit board 51, respectively. The ground connection terminal portions 87 and 88 are connected by a solder to through holes 93 formed on a mounting circuit board 91 as a connection object.

Each of the ground connecting portions 83 has an arm portion 83*a* and a ground contacting portion 83*b*. The arm portion 83*a* is bent from the side plate portion 81*c* through a cut portion 81*j* formed on the side plate portion 81*c* to the inside of the side plate portion 81*c*. The ground contacting portions 83*b* are contacted with the ground patterns 61 and 63 formed on the bottom surface of the circuit board 51.

The shell 81 is provided with a shell fitting portion 82 formed on the side towards the separating direction B and defined by the top plate portion 81*a*, the bottom plate portion 81*b*, and the side plate portions 81*c* and 81*d* connecting the top and the bottom plate portions 81*a* and 81*b*. The top and the bottom plate portions 81*a* and 81*b* are provided with a plurality of shell elastic contacting portions 81*f* to be contacted with a shell (not shown) of the mating connector. When the shell of the mating connector is inserted into the shell fitting portion 82 in the fitting direction A, the shell is contacted with the shell elastic contacting portions 81*f*.

The shell 81 and the housing 41 are assembled and held by press-fitting the press-fit terminal portions 85 formed on the shell 81 into the press-fit holes 45*h* formed on the housing 41. The second contacting portions 35 of the second contacts 31 are connected to conductive portions of the mounting circuit board 91 by soldering.

The shell 81 is formed by punching a conductive plate using a press and bending the conductive plate. When the shell 81 is coupled with the housing 41, the shell 81 and the ground patterns 61 and 63 of the circuit board 51 are mechanically and electrically connected to each other by elasticity of the wide ground connecting portions 83 formed on the side surfaces of the shell 81.

Furthermore, at least one of the ground connection terminal portions 87 and 88 of the shell 81 are electrically connected to a ground portion (not shown) formed on the mounting circuit board 91 by soldering. Thus, the ground patterns 61 and 63 of the circuit board 51 are electrically connected to the ground portion of the mounting circuit board 91 through the shell 81 with a low connection impedance and a low connection inductance. Therefore, in case where the capacitor 79 is inserted in parallel as described in conjunction with FIG. 9, the circuit board 51 has a resonance frequency within a high-frequency region and ground bounce is reduced. Further, an attenuation effect as a filter is not degraded and excellent characteristics can be obtained.

The first connecting portions 53 of the circuit board 51 inserted and received in the receiving portion 41 a of the housing are brought into elastic contact with the first elastic contacting portions 27 of the first contacts 21 without disturbing a characteristic impedance. The second connecting portions 55 of the circuit board 51 inserted and received in the receiving portion 41*a* of the housing 41 are brought into elastic contact with the second elastic contacting portions 37 of the second contacts 31 without disturbing the characteristic impedance.

The first contacts 21 and the circuit board 51 are mechanically and electrically connected to each other by elasticity of the first elastic contacting portions 27. The second contacts 31 and the circuit board 51 are mechanically and electrically connected to each other by elasticity of the second elastic contacting portions 37.

The shell 81 serves to suppress electromagnetic waves radiated from or received by the circuit board 51 and to reduce the influence of temperature variation upon the circuit board 51 during a soldering step when the connector is mounted to the mounting circuit board 91.

The shell 81 has the ground connecting portions 83 to be connected to the ground patterns 61 and 63 of the circuit board 51, and the ground connection terminal portions 87 and 88 to be connected to the ground pattern of the mounting circuit board 91. By connecting the ground connecting portions 83 and the ground connection terminal portions 87 and 88 by a solder with a low impedance, it is possible to electrically connect the ground patterns 61 and 63 of the circuit board 51 and the ground pattern (not shown) of the mounting circuit board 91 with a low impedance and a low inductance. Therefore, the resonance frequency of the circuit board 51 can be increased.

The above-mentioned connector is suitable as a small-sized connector such as a USB (Universal Serial Bus) connector.

Although this invention has been described in conjunction with the preferred embodiment thereof, this invention may be modified in various other manners within the scope of the appended claims.

What is claimed is:

1. A connector to be mounted to a connection object, the connector comprising:

a conductive first contact;

a conductive second contact;

an insulating housing holding the first and the second contacts;

a circuit board with an electronic element mounted thereon, the circuit board having opposite surfaces; and a conductive shell covering the insulating housing;

the insulating housing having a receiving portion for receiving and holding the circuit board;

the first contact comprising:

a first contacting portion to be contacted with a mating connector; and a first elastic contacting portion brought into elastic contact with the circuit board;

the second contact comprising:

a second contacting portion to be connected to the connection object; and a second elastic contacting portion brought into elastic contact with one of the opposite surfaces;

the circuit board comprising:

a conductive first connecting portion disposed on the circuit board to be connected to the first elastic contacting portion;

a conductive second connecting portion disposed on the circuit board to be connected to the second elastic contacting portion; and a pair of ground patterns disposed on the circuit board with the first and the second connecting portions interposed therebetween;

the shell having ground connecting portions brought into contact with another of the opposite surfaces and connected to the ground patterns, and a press-fit terminal portion to be press-fitted into a groove portion of the insulating housing;

the insulating housing having a pair of guide grooves faced to each other at positions corresponding to the receiving portion;

the guide grooves extending in a fitting direction of the mating connector;

the circuit board being pinched between the second elastic contacting portion and the ground connecting portions and supported with its opposite end portions inserted into the guide grooves.

2. The connector according to claim 1, wherein the electronic element is connected to the first and the second connecting portions.

3. The connector according to claim 2, wherein the first and the second connecting portions are disposed at opposite end portions of the circuit board;

the circuit board further having:

a conductive first circuit pattern connected to the first connecting portion; and a conductive second circuit pattern connected to the second connecting portion;

the electronic element being connected to the first and the second connecting portions through the first and the second circuit patterns.

4. The connector according to claim 3, wherein the circuit board is disposed in parallel to a fitting direction of the mating connector, the first and the second connecting portions being disposed at positions corresponding to each other in the fitting direction.

5. The connector according to claim 4, wherein the first and the second circuit patterns extend from the first and the second connecting portions in directions towards each other.

6. The connector according to claim 5, wherein the electronic element is connected to extending ends of the first and the second circuit patterns.

7. The connector according to claim 1, wherein the electronic element includes at least one of a resistor, an inductor, and a capacitor.

* * * * *